US006611190B2

(12) United States Patent
Chui et al.

(10) Patent No.: US 6,611,190 B2
(45) Date of Patent: Aug. 26, 2003

(54) TRANSFORMER FOR INVERTER CIRCUIT

(75) Inventors: Tzu-To Chui, Hsinchu (TW); Cheng-Chia Hsu, Hsinchu (TW); Yung-Chm Chou, Hsinchu (TW)

(73) Assignee: Ambit Microsystems Corp., Hsinchu (TW)

( * ) Notice: Subject to any disclaimer, the term of this patent is extended or adjusted under 35 U.S.C. 154(b) by 0 days.

(21) Appl. No.: 09/952,416

(22) Filed: Sep. 11, 2002

(65) Prior Publication Data

US 2003/0038696 A1 Feb. 27, 2003

(30) Foreign Application Priority Data

Aug. 17, 2001 (TW) ..... 90120215 A

(51) Int. Cl.[7] ..... H01F 27/30
(52) U.S. Cl. ..... 336/198; 336/208; 336/145
(58) Field of Search ..... 336/208, 198, 336/192, 212, 145, 147

(56) References Cited

U.S. PATENT DOCUMENTS 3,990,030 A * 11/1976 Chamberlin ..... 336/65
4,347,490 A * 8/1982 Peterson ..... 336/60
4,352,081 A * 9/1982 Kijima ..... 336/198
5,914,843 A * 6/1999 Hopkins et al. ..... 361/42
6,429,762 B1 * 8/2002 Shusterman et al. ..... 336/84 R

FOREIGN PATENT DOCUMENTS

JP 58080818 * 5/1983 ..... 29/606
JP 10174448 * 6/1998

* cited by examiner

*Primary Examiner*—Anh Mai
(74) *Attorney, Agent, or Firm*—Ladas & Parry

(57) ABSTRACT

A transformer for an inverter circuit, comprising: a core module having a first core portion and a second core portion; a first bobbin having a first coiled portion and a first hollow portion for receiving the first core portion; a second bobbin substantially disposed parallel to the first bobbin, the second bobbin having a second coiled portion and a second hollow portion for receiving the second core portion; primary coils wound around the first coiled portion; and secondary coils wound around the second coiled portion.

15 Claims, 5 Drawing Sheets

TRANSFORMER FOR INVERTER CIRCUIT

BACKGROUND OF THE INVENTION

1. Field of the Invention

This invention relates to a transformer, and particularly to a thin-type high power transformer for use in an inverter circuit.

2. Description of the Related Art

With improvement of display technologies, liquid crystal display (LCD) monitors have gradually become common in the field of computer or other displays. Compared to CRT monitors, LCD monitors have the advantages of slimmer profiles and better display quality with less flicker. In an LCD monitor, a backlight module has high power-driven fluorescent tubes for the required backlight system. Generally, an inverter with a driving circuit is used to drive the fluorescent tubes, and the inverter has a high-voltage transformer. Thus, in order to minimize the volume of the LCD monitor, it is necessary for the transformer used in the inverter circuit to have a thin-type structure.

A conventional transformer for the inverter circuit is generally constructed such that primary coils and secondary coils are wound around a hollow bobbin, with a core inserted into the hollow portion of the bobbin. FIG. 1*a* shows an embodiment of the conventional transformer for the inverter circuit, and FIG. 1*b* shows the cross-section of the bobbin of the transformer, with the coils wound around the bobbin.

As shown in FIG. 1*a*, the conventional transformer 10 for the inverter circuit has a first E-shaped core 30*a* and a second E-shaped core 30*b*. The first E-shaped core 30*a* and the second E-shaped core 30*b* can be combined to form a closed magnetic loop. Further, the conventional transformer 10 has a bobbin 50, with a primary winding window 510 and a secondary winding window 520, and pins 530 for connecting the wire of the coils to the circuit board are provided on the two ends of the bobbin 50. A flange 515 is provided between the primary winding window 510 and the secondary winding window 520, and flanges 525 are provided to separate the secondary winding window 520 into several wound areas.

In the aforementioned structure of the bobbin 50, as shown in FIG. 1*b*, the primary winding window 510 is used wound the primary coils 610, and the secondary winding window 520 is used wound the secondary coils 620. The wire of the secondary coils 620 has a smaller diameter and winds in multi-layers; therefore, it is necessary to separate the secondary winding window 520 into several wound areas with flanges 525 in order to prevent arcing fault resulting from the high voltage difference between two adjacent layers of coils.

In the aforementioned conventional transformer for the inverter circuit, however, the primary and secondary coils are wound on the same bobbin. This structure may result in problems.

First, in the conventional transformer, the primary winding window 510 has a limited winding range, and the wire of the primary coils has a relatively larger diameter. Therefore, if the transformer is required to have primary coils 610 with more winding turns, or an additional set of primary coils 610, the coil wound thickness will be significantly increased, compromising the transformer's thin profile.

Further, if the power supplied by the transformer increases as is the case when at least two fluorescent tubes are driven by a single transformer, a noticeable raise in temperature occurs in the primary coils portion, possibly overheating the transformer. Increasing the wire diameter of the primary coils alleviates the temperature problem. By using a thick wire, however, the coil thickness will be increased. As a result, this method is not preferred.

Further, in conventional transformers, it is necessary to perform the mains isolation of the primary and secondary coils on the same bobbin. This may cause difficulty in voltage-resist treatment of the high-voltage coils, which increases the difficulty and cost of the transformer manufacture.

SUMMARY OF THE INVENTION

Therefore, an object of the present invention is to disclose a transformer used in the inverter circuit that solves the thickness problem.

Another object of the present invention is to disclose a transformer used in the inverter circuit that solves the temperature problem in the primary coils. Thus, overheating is prevented, and high power demands are met.

A further object of the present invention is to disclose a transformer used in the inverter circuit that corresponds to the requirement of mains isolation. With the present invention, the pressure-resistant treatment of the high-voltage coils is simplified, and a selected variety of coil wires may be applied, so that the difficulty and cost of transformer manufacture are alleviated.

The present invention discloses a transformer for an inverter circuit, comprising: a core module having a first core portion and a second core portion; a first bobbin having a first coiled portion and a first hollow portion for receiving the first core portion; a second bobbin substantially disposed parallel to the first bobbin, the second bobbin having a second coiled portion and a second hollow portion for receiving the second core portion; primary coils wound around the first coiled portion; and secondary coils wound around the second coiled portion.

In the above-mentioned transformer of the present invention, the core module may be a U-U structure constituted by two U-shaped cores, a U-I structure constituted by a U-shaped core and an I-shaped core, an L-L structure constituted by two L-shaped cores, an E-E structure constituted by two E-shaped cores, an E-I structure constituted by an E-shaped core and an I-shaped core, or a U-T structure constituted by a U-shaped core and a T-shaped core.

Further, the present invention discloses a thin-type high power transformer comprising: a first U-shaped core; a second U-shaped core; a first bobbin having a first hollow portion for inserting a part of the first U-shaped core and a part of the second U-shaped core; a second bobbin substantially disposed parallel to the first bobbin, the second bobbin having a second hollow portion for inserting a part of the first U-shaped core and a part of the second U-shaped core; primary coils wound around the first bobbin; and secondary coils wound around the second bobbin.

In the transformer of the present invention, the primary coils are wound around an independent first bobbin so that the winding area is not limited. Therefore, the winding layers of the primary coils are reduced, and the thin-type transformer may be achieved.

Further, in the transformer of the present invention, the wire diameter of the primary coils can be increased without significantly increasing the thickness of the transformer. Therefore, a selective variety of coil wires of the primary coils may be applied in the transformer of the present invention.

Further, in the transformer of the present invention, the primary coils does not stack windings, so the transformer maintains a relatively low temperature, and can be used in high power situations.

Further, in the transformer of the present invention, the primary and secondary coils are disposed parallel to each other, and no contact occurs between the coils, achieving the mains isolation requirement.

Further, in the transformer of the present invention, the primary and secondary coils are respectively wound around the first and second bobbins, so that the wound areas increase, and the transformer length is reduced.

Further, the transformer of the present invention is manufactured in a simpler process, and the costs are reduced.

BRIEF DESCRIPTION OF THE DRAWINGS

The present invention can be more fully understood by reading the subsequent detailed description in conjunction with the examples and references made to the accompanying drawings, wherein.

DETAILED DESCRIPTION OF THE PREFERRED EMBODIMENT

Figure 1A:
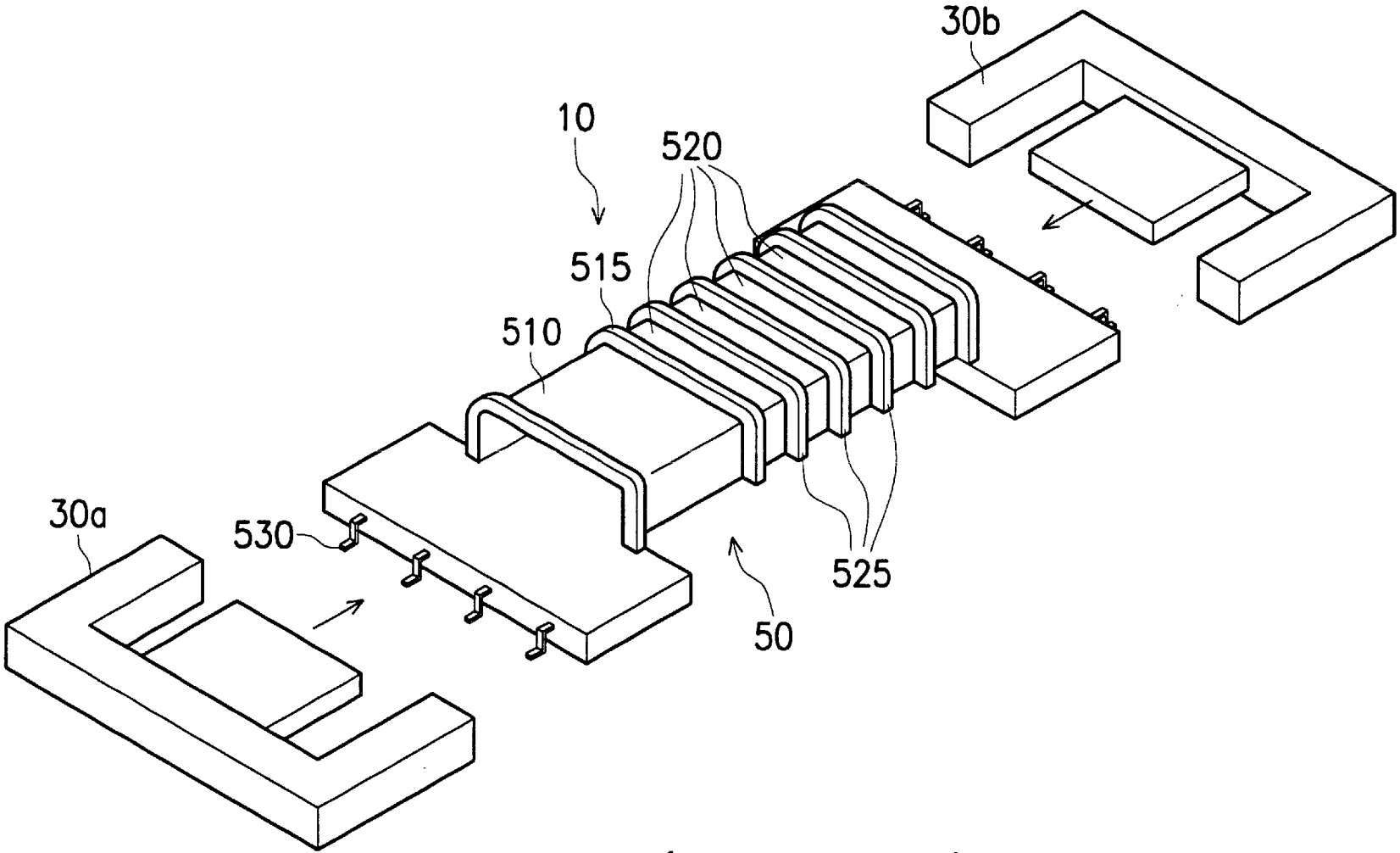
FIG. 1a (PRIOR ART)
FIG. 1*a* is a perspective exploded view of a conventional transformer for an inverter circuit.
Figure 1B:
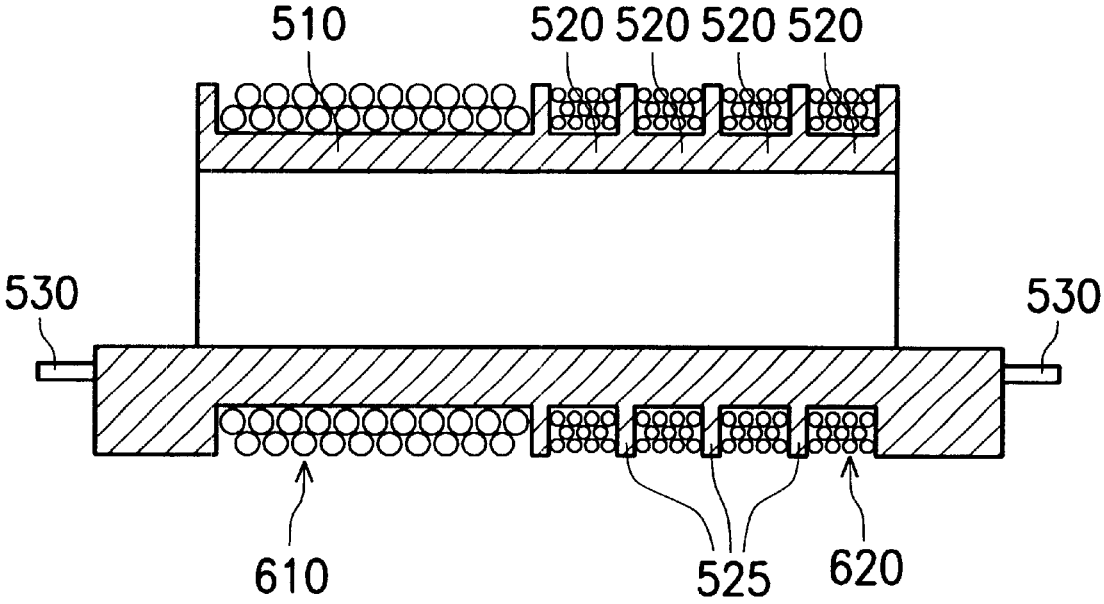
FIG. 1b (PRIOR ART)
FIG. 1*b* is a cross-section showing the primary and secondary coils wound around the bobbin of the conventional transformer.
Figure 2A:
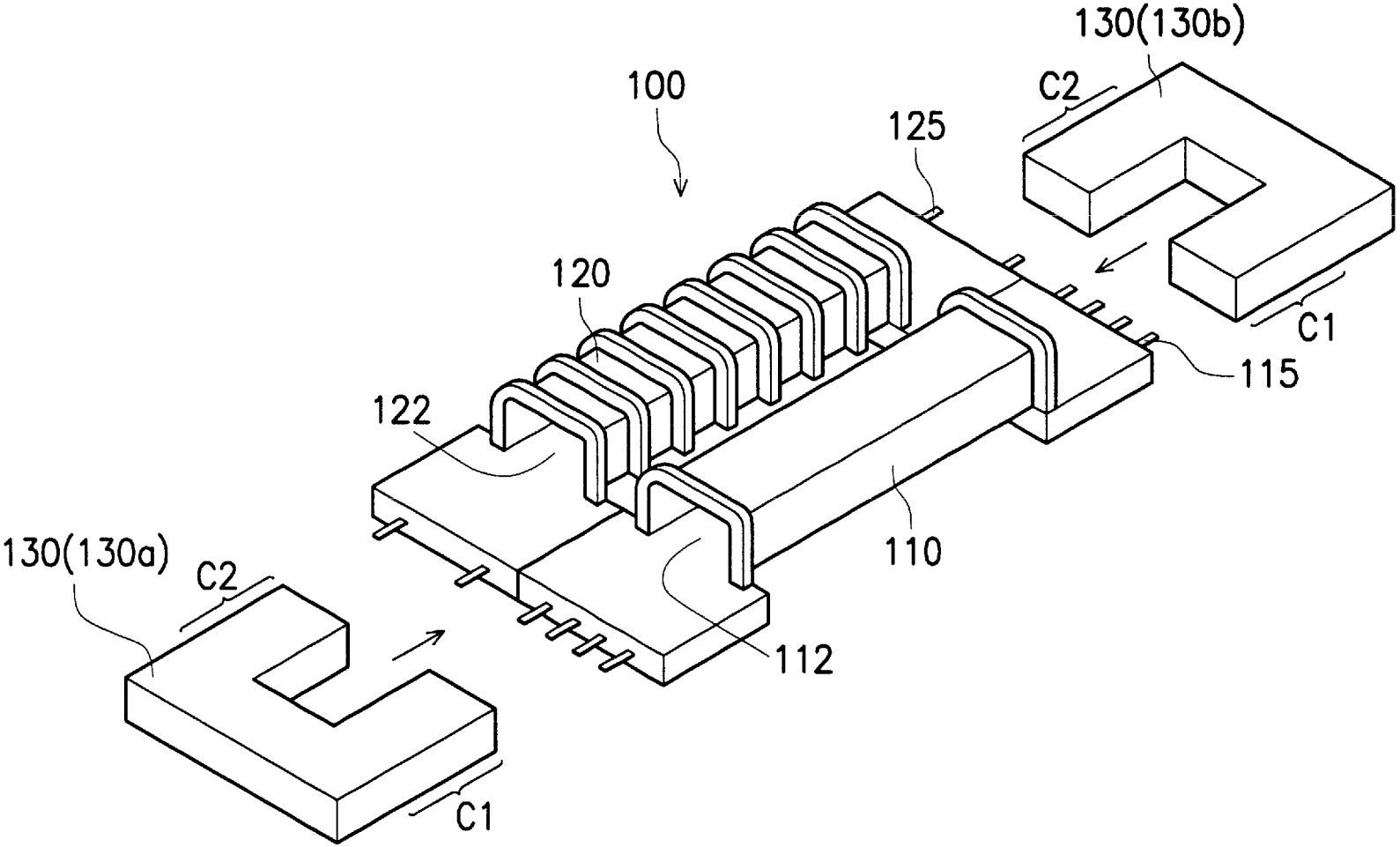
FIG. 2*a* is a perspective exploded view showing an embodiment of the transformer for an inverter circuit of the present invention.
Figure 2B:
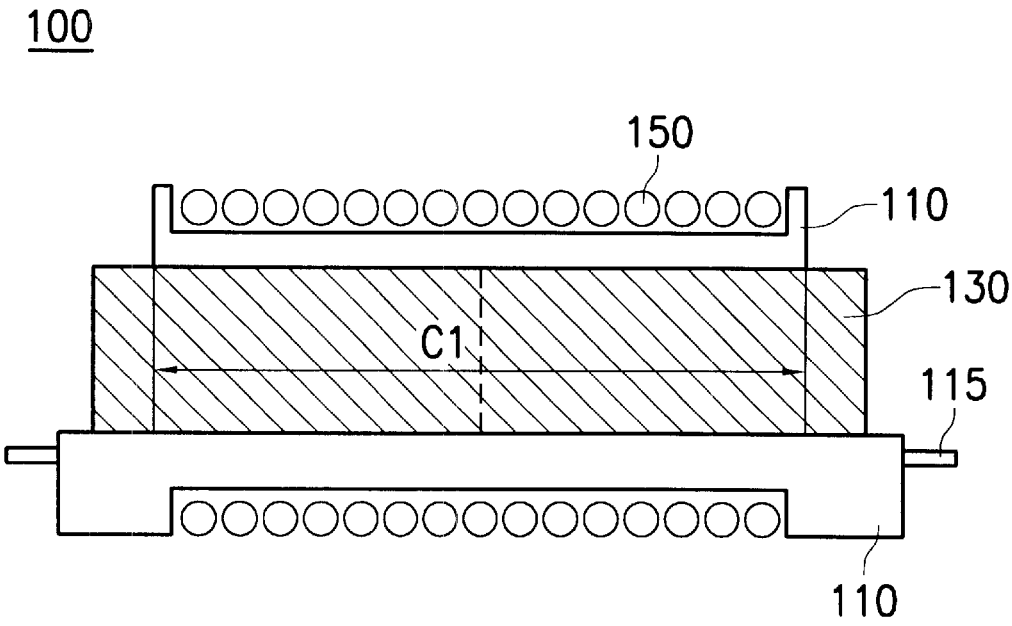
FIG. 2*b* is a cross-section showing the primary coils of the transformer of the present invention.
Figure 2C:
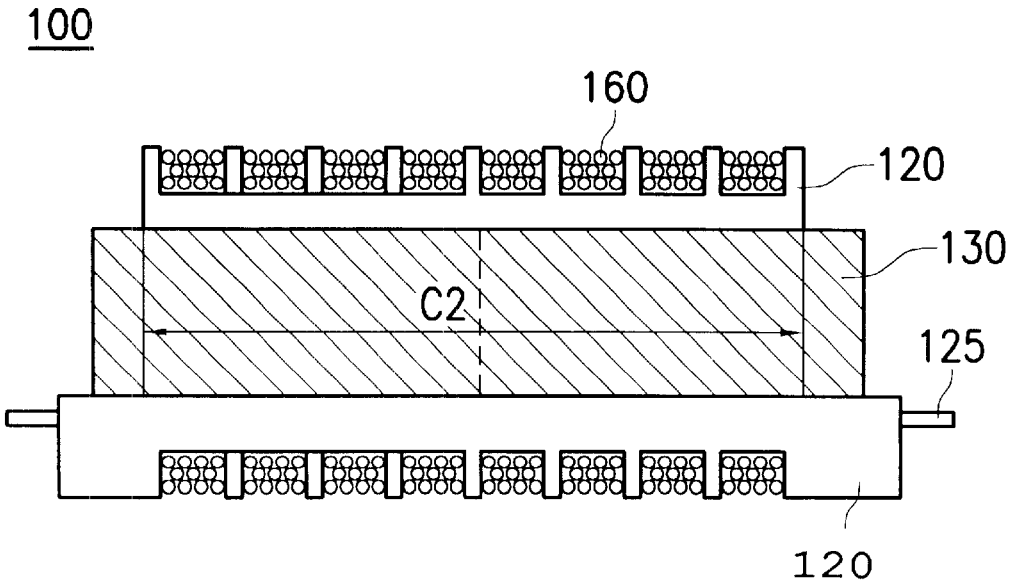
FIG. 2*c* is a cross-section showing the secondary coils of the transformer of the present invention.

A preferred embodiment of the transformer for the inverter circuit of the present invention is shown in FIG. 2*a* to FIG. 2*c*. As shown in FIG. 2*a*, the transformer 100 for the inverter circuit of the present invention has a first bobbin 110 for the winding of the primary coils, a second bobbin 120 for the winding of the secondary coils, and a core module 130. The first bobbin 110 and the second bobbin 120 are substantially arranged in parallel, and each has a first hollow portion 112 and a second hollow 122 respectively, and each has a winding window respectively for winding of the primary and secondary coils. In order to prevent arcing fault of the secondary coils, the winding window of the second bobbin 120 is separated into several wound areas by a plurality of flanges. Further, the core module 130 has a first U-shaped core 130*a* and a second U-shaped core 130*b*, which can be inserted to the first hollow portion 112 and the second hollow portion 122 from the opposite ends of the first bobbin 110 and the second bobbin 120 to form a O-shaped closed magnetic loop. In this case, the part of the first U-shaped core 130*a* and the part of the second U-shaped core 130*b* received in the first hollow portion 112 are hereinafter referred to a first core portion C1, and the part of the first U-shaped core 130*a* and the part of the second U-shaped core 130*b* received in the second hollow portion 122 are hereinafter referred to a second core portion C2.

Description of the primary and secondary coils will be hereinafter disclosed in reference to FIG. 2*b* and FIG. 2*c*.

As shown in FIG. 2*b*, the primary coils 150 of the present invention are wound around the first bobbin 110. First pins 115 are provided at opposite sides of the first bobbin 110, and the first core portion C1 is inserted in the first bobbin 110. Compared to the conventional transformer, the primary coils 150 are wound around the independent first bobbin 110, so that the wound area is not limited as in the prior art. Therefore, the thickness of the primary coils is reduced, and the wire diameter of the primary coils can be increased without significantly increasing the thickness of the transformer, which induces a selective variety of coil wires of the primary coils. In the transformer of the present invention, the primary coils are preferably wound in two layers and most preferably wound in a single layer. The primary coils do not stack windings, so the transformer maintains a relatively low temperature, and can be used in high power situations.

Further, as shown in FIG. 2*c*, the secondary coils 160 of the present invention are wound around the second bobbin 120. Second pins 125 are provided at opposite sides of the second bobbin 120, and the second core portion C2 is inserted in the second bobbin 120. The first bobbin 110 and the second bobbin 120 are substantially in a parallel arrangement; that is, the first core portion C1 and the second core portion C2 are substantially in a parallel arrangement, and the primary coils 150 and the secondary coils 160 wound around the bobbins 110, 120 are thus arranged in parallel. Due to the parallel arrangement of the primary and secondary coils 150, 160, no contact occurs between the wires of the coils, so that it is simple to achieve the mains isolation requirement and perform the voltage-resist treatment.

In the above-mentioned arrangement, the primary and secondary coils 150 and 160 are respectively wound around the first bobbin 110 and the second bobbin 120, so that both of the bobbins have a wider wound area; that is, the total length of the transformer can be relatively reduced. As shown in FIG. 2*a*, the first bobbin 110 does not have a flange, and the second bobbin 120 has flanges at an equal distance; as a result, the unequal areas of the first winding window and the second winding window as shown in the conventional bobbin are not required. Therefore, the transformer of the present invention can be manufactured with a simplified process, effectively reducing the cost.

Figure 3:
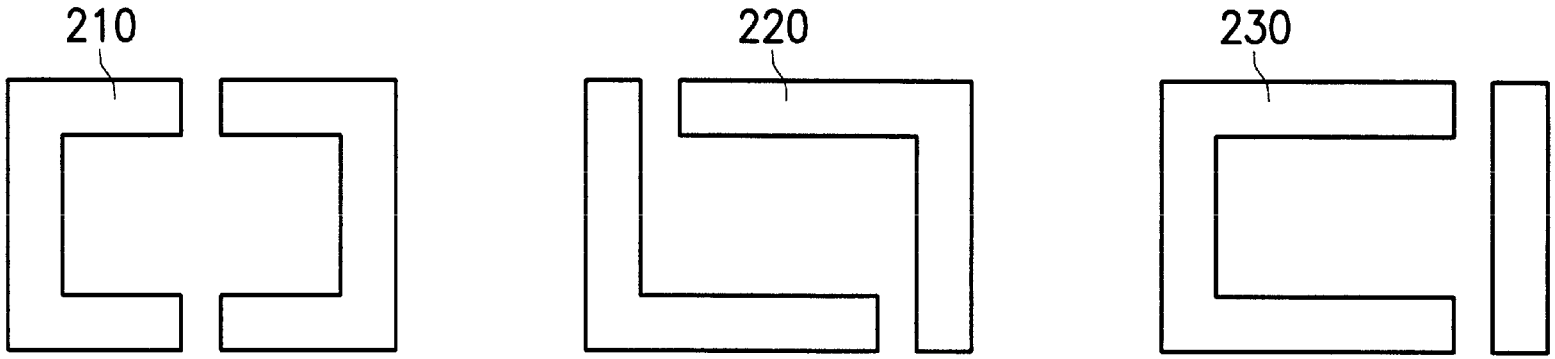
FIG. 3 is a plan view showing the embodiments of the combination structure of the core module.
Figure 4:
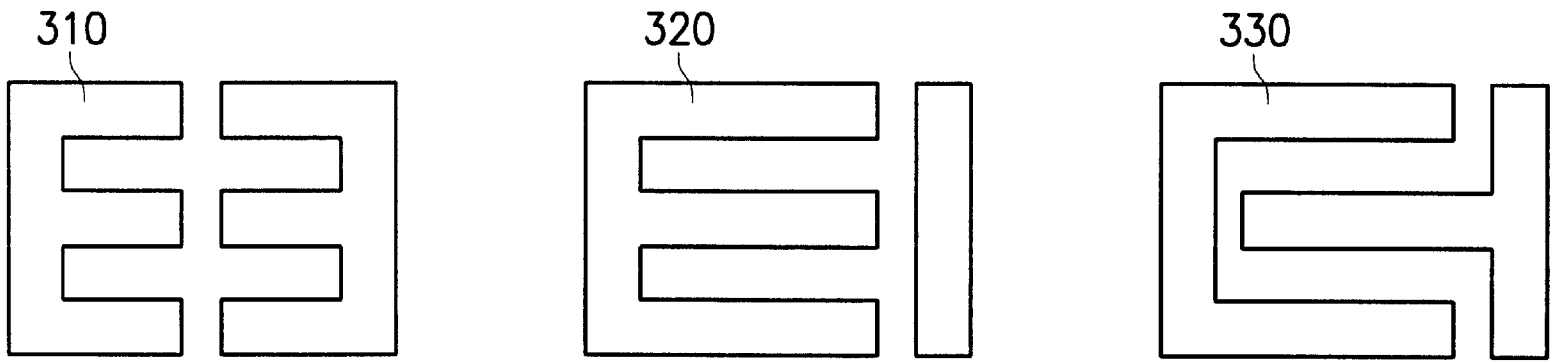
FIG. 4 is a plan view showing other embodiments of the combination structure of the core module.

It should be noted that, as shown in FIG. 3, the core module 130 of the present invention shown in FIG. 2*a* to FIG. 2*c* is a U-U structure 210 constituted by two U-shaped cores. In the U-U structure 210, the joint positions (the dotted line in the core module 130 of FIG. 2*b* and FIG. 2*c*) can be for example connected with glue or other adhesive methods. However, various shapes or structures of the core module 130 with a first core portion and a second core portion arranged in parallel can be applied to the present invention. For example, an L-L structure 220 constituted by two L-shaped cores and a U-I structure 230 constituted by a U-shaped core and an I-shaped core as shown in FIG. 3, or an E-E structure 310 constituted by two E-shaped cores, an E-I structure 320 constituted by an E-shaped core and an I-shaped core, and a U-T structure 330 constituted by a U-shaped core and a T-shaped core as shown in FIG. 4 are respectively applicable in the present invention. Any other core module structures with two core portions arranged in parallel are also acceptable.

While the present invention has been described with reference to the preferred embodiments thereof, it is to be understood that the invention is not limited to the described embodiments or constructions. On the contrary, the invention is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A transformer for an inverter circuit, comprising:

a core module having a first core portion and a second core portion;

a first bobbin having a first coiled portion and a first hollow portion for receiving the first core portion;

a second bobbin substantially disposed parallel to the first bobbin, the second bobbin having a second coiled portion and a second hollow portion for receiving the second core portion;

primary coils wound around the first coiled portion; and secondary coils wound around the second coiled portion.

2. The transformer according to claim 1, wherein the core module comprises two U-shaped cores.

3. The transformer according to claim 1, wherein the core module comprises a U-shaped core and an I-shaped core.

4. The transformer according to claim 1, wherein the core module comprises two L-shaped cores.

5. The transformer according to claim 1, wherein the core module comprises two E-shaped cores.

6. The transformer according to claim 1, wherein the core module comprises an E-shaped core and an I-shaped core.

7. The transformer according to claim 1, wherein the core module comprises a U-shaped core and a T-shaped core.

8. The transformer according to claim 1, wherein the primary coils are wound in at most two layers.

9. The transformer according to claim 1, further comprising a plurality of flanges spaced along the entire length of the second bobbin.

10. A thin-type high power transformer used in an inverter for driving a discharge tube, the transformer comprising:

a first U-shaped core;

a second U-shaped core;

a first bobbin having a first hollow portion for inserting a part of the first U-shaped core and a part of the second U-shaped core;

a second bobbin substantially disposed parallel to the first bobbin, the second bobbin having a second hollow portion for inserting a part of the first U-shaped core and a part of the second U-shaped core;

primary coils wound around the first bobbin; and secondary coils wound around the second bobbin.

11. The transformer according to claim 10, wherein the primary coils are wound in at most two layers.

12. The transformer according to claim 10, further comprising a plurality of flanges spaced along the entire length of the second bobbin.

13. A transformer for an inverter circuit, comprising:

a core module having a first core portion and a second core portion;

a first bobbin having a first coiled portion and a first hollow portion for receiving the first core portion;

a second bobbin having a plurality of flanges, the second bobbin substantially disposed parallel to the first bobbin, the second bobbin having a second coiled portion and a second hollow portion for receiving the second core portion;

primary coils wound around the first coiled portion; and secondary coils wound around the second coiled portion.

14. The transformer according to claim 13, wherein the primary coils are wound in at most two layers.

15. The transformer according to claim 13, wherein the plurality of flanges are spaced along the entire length of the second bobbin.

* * * * *